US012577954B2

(12) United States Patent
Dreiss et al.

(10) Patent No.: US 12,577,954 B2
(45) Date of Patent: Mar. 17, 2026

(54) AXIAL DIRECT DRIVE SEALLESS PUMP OR TURBINE WITH DEFORMATION-RESISTANT COVER PLATE

(71) Applicant: Flowserve Pte. Ltd., Singapore (SG)

(72) Inventors: Andreas Dreiss, Geestland (DE); Zachary Dennis, Emmaus, PA (US); Neil Havrilla, Coplay, PA (US); Sean A. Cain, Tulsa, OK (US)

(73) Assignee: Flowserve Pte. Ltd., Singapore (SG)

( * ) Notice: Subject to any disclaimer, the term of this patent is extended or adjusted under 35 U.S.C. 154(b) by 112 days.

(21) Appl. No.: 18/407,972

(22) Filed: Jan. 9, 2024

(65) Prior Publication Data

US 2025/0223968 A1 Jul. 10, 2025

(51) Int. Cl.

| | |
|---|---|
| ***F04D 13/06*** | (2006.01) |
| ***F04D 25/06*** | (2006.01) |
| ***F04D 29/08*** | (2006.01) |

(52) U.S. Cl.

CPC ..... *F04D 13/06* (2013.01); *F04D 13/0606* (2013.01); *F04D 13/0653* (2013.01); *F04D 25/066* (2013.01); *F04D 29/08* (2013.01)

(58) Field of Classification Search

CPC .. F04D 13/06; F04D 13/0606; F04D 13/0653; F04D 25/0606; F04D 29/08

See application file for complete search history.

(56) References Cited

U.S. PATENT DOCUMENTS

| | | | |
|---|---|---|---|
| 1,632,357 A | 6/1927 | White | |
| 1,949,796 A | 3/1934 | Himmel | |
| 2,438,629 A | 3/1948 | Anderson | |
| 2,440,947 A | 5/1948 | Hart | |
| 2,752,857 A * | 7/1956 | White | F04D 13/0666 310/104 |

(Continued)

FOREIGN PATENT DOCUMENTS

| | | |
|---|---|---|
| CN | 205791947 U | 12/2016 |
| CN | 116505702 A | 7/2023 |

(Continued)

OTHER PUBLICATIONS

Tapered Plugs; 2022.*

(Continued)

*Primary Examiner* — Christopher S Bobish

(74) *Attorney, Agent, or Firm* — Maine Cernota & Curran

(57) ABSTRACT

An axial direct drive integral motor pump (IMP) or integral motor turbine (IMT) includes a stator or impeller housing hermetically sealed in front by a cover plate. At least one port in a housing rear face enables a barrier material, such as a resin, to be injected into the housing after attachment of the cover plate, so that the barrier material abuts the cover plate with substantially no gap therebetween. The barrier plate is thereby protected from undue deformation and damage by a pressurized process fluid. The barrier material can be injected through one or more fill ports by vacuum impregnation, and/or displaced air can escape through one or more drain ports. The ports can be sealed by plugs. The ports and plugs can be threaded and/or tapered. The coefficient of thermal expansion (CTE) of the barrier material can be substantially equal to a CTE of the first housing.

18 Claims, 8 Drawing Sheets

(56) References Cited

U.S. PATENT DOCUMENTS

| | | | | | |
|---|---|---|---|---|---|
| 2,782,721 | A * | 2/1957 | White | F04D 13/0666 | 417/357 |
| 2,824,520 | A | 2/1958 | Bartels | | |
| 2,855,141 | A | 10/1958 | Van Rijn | | |
| 2,968,249 | A | 1/1961 | Caine | | |
| 3,102,679 | A | 9/1963 | Rudy | | |
| 3,135,212 | A | 6/1964 | Todd | | |
| 3,364,866 | A | 1/1968 | Sato | | |
| 3,513,942 | A * | 5/1970 | Sato | F04D 13/0666 | 415/206 |
| 3,719,436 | A * | 3/1973 | McFarlin | H02K 7/14 | 417/356 |
| 3,767,330 | A * | 10/1973 | Signorile | F04D 13/0666 | 417/420 |
| 3,868,196 | A | 2/1975 | Lown | | |
| 4,213,745 | A | 7/1980 | Roberts | | |
| 4,508,998 | A | 4/1985 | Hahn | | |
| 4,728,268 | A * | 3/1988 | Laing | F16C 17/08 | 417/420 |
| 4,806,080 | A * | 2/1989 | Mizobuchi | F16C 33/043 | 384/123 |
| 5,117,141 | A | 5/1992 | Hawsey | | |
| 5,149,253 | A * | 9/1992 | Miyamoto | F04D 13/0666 | 417/372 |
| 5,158,440 | A | 10/1992 | Cooper | | |
| 5,269,664 | A | 12/1993 | Buse | | |
| 5,332,374 | A * | 7/1994 | Kricker | F04D 13/027 | 417/420 |
| 5,370,509 | A * | 12/1994 | Golding | F04D 29/0467 | 417/423.1 |
| 5,494,418 | A | 2/1996 | Moriya | | |
| 5,567,133 | A | 10/1996 | Kobaybashi | | |
| 5,713,727 | A | 2/1998 | Veronesi et al. | | |
| 6,012,909 | A * | 1/2000 | Sloteman | F04D 29/5806 | 417/370 |
| 6,034,465 | A * | 3/2000 | McKee | F04D 13/0666 | 417/406 |
| 6,056,518 | A | 5/2000 | Allen | | |
| 6,135,098 | A | 10/2000 | Allen | | |
| 6,175,173 | B1 * | 1/2001 | Stephan | F04D 29/5813 | 417/357 |
| 6,422,838 | B1 | 7/2002 | Sloteman | | |
| 6,835,051 | B2 | 12/2004 | Heim | | |
| 7,067,950 | B2 | 6/2006 | Hirzel | | |
| 8,303,268 | B2 | 11/2012 | Werson | | |
| 9,097,256 | B2 * | 8/2015 | Yokozawa | F04D 13/0693 | |
| 9,722,464 | B2 * | 8/2017 | Passman | H02K 1/12 | |
| 10,935,029 | B2 * | 3/2021 | Kuronuma | F04D 13/0666 | |
| 11,323,003 | B2 * | 5/2022 | Judge | F04D 1/066 | |
| 11,434,911 | B2 * | 9/2022 | Otsuki | F04D 13/06 | |
| 2002/0035974 | A1 | 3/2002 | Pawellek | | |
| 2002/0106290 | A1 | 8/2002 | Bader | | |
| 2003/0021683 | A1 | 1/2003 | Capone | | |
| 2004/0013547 | A1 | 1/2004 | Allen | | |
| 2005/0196269 | A1 | 9/2005 | Racer | | |
| 2007/0048158 | A1 | 3/2007 | Kochan, Jr. | | |
| 2007/0273225 | A1 * | 11/2007 | Head | H02K 7/003 | 310/152 |
| 2009/0208349 | A1 | 8/2009 | Eller | | |
| 2011/0164995 | A1 | 7/2011 | Genster | | |
| 2011/0238172 | A1 | 9/2011 | Akdis | | |
| 2011/0318175 | A1 | 12/2011 | Converse | | |
| 2013/0028760 | A1 | 1/2013 | Lin | | |
| 2013/0195696 | A1 * | 8/2013 | Sugimura | H02K 11/33 | 417/410.1 |
| 2013/0213325 | A1 | 8/2013 | Kim | | |
| 2013/0236341 | A1 | 9/2013 | Anderson | | |
| 2015/0104335 | A1 | 4/2015 | Faller | | |
| 2016/0006379 | A1 | 1/2016 | Wang et al. | | |
| 2016/0072362 | A1 | 3/2016 | Kube | | |
| 2016/0281698 | A1 * | 9/2016 | Kinoshita | F04C 18/30 | |
| 2016/0305447 | A1 | 10/2016 | Dreiss et al. | | |
| 2019/0145428 | A1 * | 5/2019 | Judge | F04D 13/0606 | 417/366 |
| 2019/0280552 | A1 | 9/2019 | Kuratani | | |
| 2019/0301480 | A1 * | 10/2019 | Ojima | H02K 5/1675 | |
| 2020/0067376 | A1 | 2/2020 | Judge | | |

FOREIGN PATENT DOCUMENTS

| | | | |
|---|---|---|---|
| EP | 2626573 | A1 | 8/2013 |
| JP | 2000069696 | A | 3/2000 |
| WO | 9908366 | A1 | 2/1999 |
| WO | 2010081123 | A1 | 7/2010 |

OTHER PUBLICATIONS

International Search Report and Written Opinion for International Application No. PCT/US2024/062033 mail date Apr. 17, 2025, 12 pages.

PCT International Search Report & Written Opinion for Appl No. PCT/US2018/060690 dtd Mar. 12, 2019, 17 pages.

Office Action for U.S. Appl. No. 16/204,997 dated Jul. 2, 2020, 6 Pages.

Office Action for U.S. Appl. No. 16/668,665, dated Dec. 4, 2020, 6 Pages.

Office Action for U.S. Appl. No. 16/668,665, dated Jan. 15, 2021, 50 Pages.

International Search Report and Written Opinion for PCT Appl. No. PCT/US2020/056972, mail date Feb. 17, 2021, 11 Pages.

Office Action for U.S. Appl. No. 16/668,665, dated May 3, 2021, 27 Pages.

Advisory Action for U.S. Appl. No. 16/668,665 mail date Jul. 14, 2021, 5 pages.

Notice of Allowance for U.S. Appl. No. 16/668,665 mail date Feb. 22, 2022, 17 Pages.

International Preliminary Report on Patentability for PCT Appl. No. PCT/US2020/056972 Mail Date May 12, 2022, 8 pages.

Office Action for India Appl. No. 202217025766, dated Aug. 18, 2022, 7 Pages.

Extended European Search Report of EP Appl No. 20882691.7, mail date Nov. 11, 2022, 8 pages.

Office Action for JP application No. 2022-524573 mail date Jul. 18, 2023, 6 pages.

* cited by examiner

AXIAL DIRECT DRIVE SEALLESS PUMP OR TURBINE WITH DEFORMATION-RESISTANT COVER PLATE

RELATED APPLICATIONS

This application is related to U.S. Pat. No. 11,323,003, issued on May 3, 2022, which is also herein incorporated by reference in its entirety for all purposes.

FIELD OF THE INVENTION

The invention relates to pumps and turbines, and more particularly, to axial integral motor pumps and integral motor turbines.

BACKGROUND OF THE INVENTION

With reference to FIG. 1, integral motor pumps (IMPs) and integral motor turbines (IMTs), which are sometimes referred to as "sealless" pumps and turbines because the housing 104 is not penetrated by a drive shaft, are centrifugal devices that combine an impeller 100 and a motor or generator 102 into an integrated apparatus within a common housing 104. Typically, the impeller 100 is attached to a rotating shaft 114 that is also fixed to the armature 108 of a motor 102. For simplicity, the present disclosure sometimes refers simply to IMPs, i.e. to pumps that include motors. However, it will be understood that the disclosure presented herein applies equally to turbines that include generators, and that references herein to IMPs and other pumps refer generically to both pumps (IMPs) and turbines (IMTs), while references to motors refer generically to motors and generators or alternators, unless otherwise stated or required by context.

The stator assembly of an IMP or IMT typically includes an induction coil assembly 106 comprising laminated steel, insulated copper wire and insulation material. The rotatable armature 108 comprises an induction coil assembly (induction coil assembly) if it is an asynchronous induction type motor, or a permanent magnet assembly if it is a synchronous type motor. Often, IMPs and IMTs are submerged in a process fluid, rendering it important in many cases to hermetically seal their sensitive magnetic and electrical assemblies within respective housings to protect them from contamination and conductive fluids.

For some applications, it can be disadvantageous to implement a separate motor 102 connected by a rotating shaft 114 to the impeller 100. For example, this approach can consume a relatively large volume of space, and the relatively long, rotating shaft 114 can lead to excitation of vibrational "eigenfrequencies" when operating at high speeds. Instead, an axial "direct drive" configuration may be preferred, such as the examples disclosed in U.S. Pat. No. 11,323,003, which is also by the present applicant, and is herein incorporated by reference in its entirety for all purposes.

According to the axial direct drive approach, the induction coil assembly or permanent magnet assembly of the "rotor" is hermetically sealed within a "rotor housing" and directly fixed to a distal side of the impeller, while the stator coils are hermetically sealed within a separate "stator housing." The rotor permanent magnets or induction coils are configured to pass in close axial proximity to the stator coils as the impeller rotates, thereby directly receiving energy from the stator coils, in the case of an IMP, or directly transferring energy to the stator coils, in the case of an IMT.

The stator housing and the rotor housing are hermetically sealed by closely spaced, opposing, annular cover plates that are sealed about their outer and inner perimeters, for example by welding.

For simplicity of expression, the present disclosure sometimes refers herein simply to the "stator housing." However, it will be understood that, unless otherwise stated or required by context, such references refer to either or both of the stator housing and the rotor housing, depending on whether the rotor coils or magnets are hermetically sealed within a rotor housing by a cover plate, the stator coils are hermetically sealed within a stator housing by a cover plate, or both.

Typically, the stator housing is filled with a barrier material, such as a resin filler, before the cover plate is applied. This approach results in an air "gap" between the barrier material and the cover plate that is at ambient pressure. To some degree, this air gap can be beneficial, in that it allows the barrier material and the housing to expand and contract unequally with temperature, without generating undue stress between the barrier material and the cover plate.

However, when the IMP or IMT module is filled with a process fluid that is above ambient pressure, the resulting pressure differential can apply a significant axial force to the cover plate, causing the cover plate to be deformed and deflected inward. Depending on the depth of the air gap within the housing, the deformation of the cover plate may be limited by direct contact between the deformed cover plate and the underlying barrier material. However, it can be difficult to precisely control the height to which the housing is filled with the barrier material, such that the depth of the air "gap" can vary between nominally identical IMP and IMT modules. Accordingly, a danger exists that, for some housings, the deflection of the cover plate may progress until the cover plate is cracked and the hermetic seal of the housing is breached, allowing process fluid to pass into the interior of the housing. This danger can be increased when the IMP or IMT is applied to a cryogenic process liquid, such as liquid hydrogen, due to an increased brittleness of the cover plate material at very low temperatures.

What is needed, therefore, is an integrated motor pump (IMP) or integrated motor turbine (IMT) module having an axial direct drive configuration for which the cover plates of a hermetically sealed rotor and/or stator housing will not be damaged by excess deformation when exposed to a high-pressure process fluid.

SUMMARY OF THE INVENTION

The present invention is an integrated motor pump (IMP) or integrated motor turbine (IMT) module having an axial direct drive configuration for which the cover plates of a hermetically sealed rotor and/or stator housing will not be damaged by excess deformation when exposed to a high-pressure process fluid.

For simplicity of expression, the present disclosure sometimes refers generically to IMPs, i.e. to pumps that include motors. However, it will be understood that the disclosure presented herein applies equally to turbines that include alternators or generators, and that references herein to IMPs and other pumps refer generically to both pumps (IMPs) and turbines (IMTs), while references to motors refer generically to motors and generators or alternators, unless otherwise stated or required by context.

The disclosed IMP or IMT module is similar in some regards to the "sealless" IMP and IMT modules disclosed by U.S. Pat. No. 11,323,003, also by the present applicant, which is herein incorporated by reference in its entirety for all purposes. The "rotor," i.e. the assembly of rotating components, in the IMP or IMT module comprises an impeller, and a plurality of induction coils or permanent magnets cooperative with the impeller. The induction coils or permanent magnets are hermetically sealed within an annular rotor housing by a rotor cover plate. The IMP or IMT module further includes an annular stator housing containing stator coils that are positioned in axial opposition to the permanent magnets or induction coils. In embodiments, the stator housing is hermetically sealed by a stator cover plate.

The present invention is applicable to axial direct drive IMP and IMT modules that include at least one of a rotor housing hermetically sealed by a rotor cover plate and a stator housing hermetically sealed by a stator cover plate. For clarity of expression, the present disclosure sometimes refers generically to the "stator housing" and "stator cover plate," or simply to the "housing" and the "cover plate." However, it will be understood that, unless otherwise stated or required by context, such references apply to either or both of the stator housing and the rotor housing, in combination with their respective cover plates, depending on whether the rotor induction coils or permanent magnets are hermetically sealed within a rotor housing by a rotor cover plate, the stator coils are hermetically sealed within a stator housing by a stator cover plate, or both. It will also be understood that references herein to "permanent magnets" refer generically to either permanent magnets or induction coils attached to the impeller, unless otherwise required by context.

According to the present invention, at least one barrier material port is provided in a rear surface of the housing. Rather than pouring the barrier material into the housing through the open front of the housing before it is sealed by the cover plate, the cover plate is applied first, and then the barrier material ports are used to fill the housing with the barrier material, so that the barrier material directly abuts the cover plate, without any intervening gap. In embodiments, bonding of the resin or other barrier material to the cover plate is avoided by applying an anti-bonding layer to the inward face of the cover plate before it is attached to the housing.

In embodiments, the barrier material ports are provided proximate an outer diameter of the annular rear surface of the housing, and proximate an inner diameter of the annular rear surface of the housing. According to method embodiments of the present invention, the outer barrier material ports are used as barrier material fill ports through which the barrier material enters the interior of the housing, while the inner barrier material ports are used as barrier material drain ports through which displaced air escapes from the housing, or vice-versa. This arrangement promotes an orderly flow of the barrier material axially and radially into the housing as the air is displaced. In some embodiments, filling of the housing with the barrier material takes place under vacuum in a vacuum impregnation process. In some of these embodiments, barrier material drain ports are not required, and certain of these embodiments include only one barrier material fill port.

After the housing has been filled with the barrier material, the barrier material fill and drain ports are sealed. In some embodiments the barrier material fill and drain ports are threaded, and are sealed by compatibly threaded barrier material plugs. In some of these embodiments, the threaded barrier material ports and plugs are tapered, which ensures that a hermetic seal is formed between the barrier material plugs and the housing. In other embodiments, the barrier material ports are not threaded, and are sealed by inserting unthreaded barrier material plugs into the barrier material ports and then laser-welding the barrier material plugs to the housing to provide a hermetic seal. Also in these embodiments the barrier material ports and the barrier material plugs can be tapered.

For embodiments that will be subject to temperature extremes, a resin or other barrier material can be chosen having a coefficient of thermal expansion (CTE) that is substantially matched to the CTE of the housing material, thereby eliminating undue stressing of the cover plate that could otherwise arise from unequal thermal expansion or contraction of the housing and barrier material.

A first general aspect of the present invention is an integral motor pump module (IMP) or integral motor turbine module (IMT) comprising a module housing configured to enable a fluid to pass from an input thereof to an output thereof, an impeller rotatable with or about a shaft within the module housing, a plurality of permanent magnets or induction coils fixed to a distal face of the impeller, a plurality of stator coils fixed to the module housing and configured to be axially proximate the permanent magnets or induction coils when the impeller rotates, the permanent magnets or induction coils being axially separated from the stator coils by a rotor-stator gap, a first integral motor housing (first IM housing) having a first IM housing interior, the first IM housing being either an impeller housing fixed to the impeller and containing the plurality of permanent magnets or induction coils within the first IM housing interior, or a stator housing fixed to the module housing and containing the plurality of stator coils within the first IM housing interior, a first IM cover plate hermetically sealing a front face of the first IM housing, a first barrier material port penetrating a rear face of the first IM housing, a first barrier material plug configured to hermetically seal the first barrier material port, and a barrier material substantially filling the first IM housing interior in physical contact with the first IM cover plate, such that there is substantially no gap between an inward face of the first IM cover plate and the barrier material.

In embodiments, the IMP or IMT comprises both the impeller housing fixed to the impeller and containing the plurality of permanent magnets or induction coils, and the stator housing containing the plurality of stator coils, the first IM housing being one of the impeller housing and the stator housing, and a second IM housing being the other of the impeller housing and the stator housing.

In any of the above embodiments, the first barrier material port and first barrier material plug can be configured for threaded attachment to each other.

In any of the above embodiments, the first barrier material port and the first barrier material plug can both be tapered.

In any of the above embodiments, the first barrier material port can be one of a plurality of barrier material ports, and the first barrier material plug can be one of a plurality of barrier material plugs, each of the barrier material ports being sealed by a corresponding one of the barrier material plugs. In some of these embodiment, the plurality of barrier material ports comprises a second barrier material port, the first barrier material port being located radially inward of the second barrier material.

In any of the above embodiments, the barrier material can be a resin.

In any of the above embodiments, the first IM cover plate can be hermetically sealed to the front face of the first IM housing by welding. In some of these embodiments, the welding is laser welding.

In any of the above embodiments, the shaft can be a non-rotatable stud fixed to the module housing. In some of these embodiments, the non-rotatable stud is fixed to the stator housing, and thereby fixed to the module housing.

In any of the above embodiments, a coefficient of thermal expansion (CTE) of the barrier material can be substantially equal to a CTE of the first housing.

A second general aspect of the present invention is a method of filling an IM housing with a barrier material. The method includes providing an IMP or IMT according to the first general aspect, evacuating the IM housing interior, injecting the barrier material through the first barrier material port into the first IM housing interior, thereby causing the barrier material to substantially fill the first IM housing interior in physical contact with the first IM cover plate, such that there is substantially no gap between an inward face of the first IM cover plate and the barrier material, and installing the first barrier material plug in the first barrier material port, thereby hermetically sealing the first barrier material port.

Embodiments further include, before injecting the barrier material into the first IM housing interior, applying an anti-bonding layer to the inward face of the cover plate, thereby preventing adhesion of the barrier material to the inward face of the first IM cover plate.

In any of the above embodiments, a coefficient of thermal expansion (CTE) of the barrier material can be substantially equal to a CTE of the first housing.

A third general aspect of the present invention is a method of filling an IM housing with a barrier material. The method includes providing an IMP or IMT according to the first general aspect, wherein the first barrier material port is one of a plurality of barrier material ports that also includes a second barrier material port, and the first barrier material plug is one of a plurality of barrier material plugs that also includes a second barrier material plug, each of the barrier material ports being sealed by a corresponding one of the barrier material plugs, the first barrier material port being located radially inward of the second barrier material port.

The method further includes injecting the barrier material into the first IM housing interior through one of the first barrier material port and the second barrier material port, while allowing air to escape from within the first IM housing interior through the other of the first barrier material port and the second barrier material port, thereby causing the barrier material to substantially fill the first IM housing interior in physical contact with the first IM cover plate, such that there is substantially no gap between an inward face of the first IM cover plate and the barrier material, installing the first barrier material plug in the first barrier material port, thereby hermetically sealing the first barrier material port, and installing the second barrier material plug in the second barrier material port, thereby hermetically sealing the second barrier material port.

Embodiments further include, before injecting the barrier material into the first IM housing interior, applying an anti-bonding layer to the inward face of the cover plate, thereby preventing adhesion of the barrier material to the inward face of the first IM cover plate.

And in any of the above embodiments, a coefficient of thermal expansion (CTE) of the barrier material can be substantially equal to a CTE of the first housing.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is an integrated motor pump (IMP) or integrated motor turbine (IMT) module having an axial direct drive configuration for which the cover plates of a hermetically sealed rotor and/or stator housing will not be damaged by excess deformation when exposed to a high-pressure process fluid.

Figure 2A:
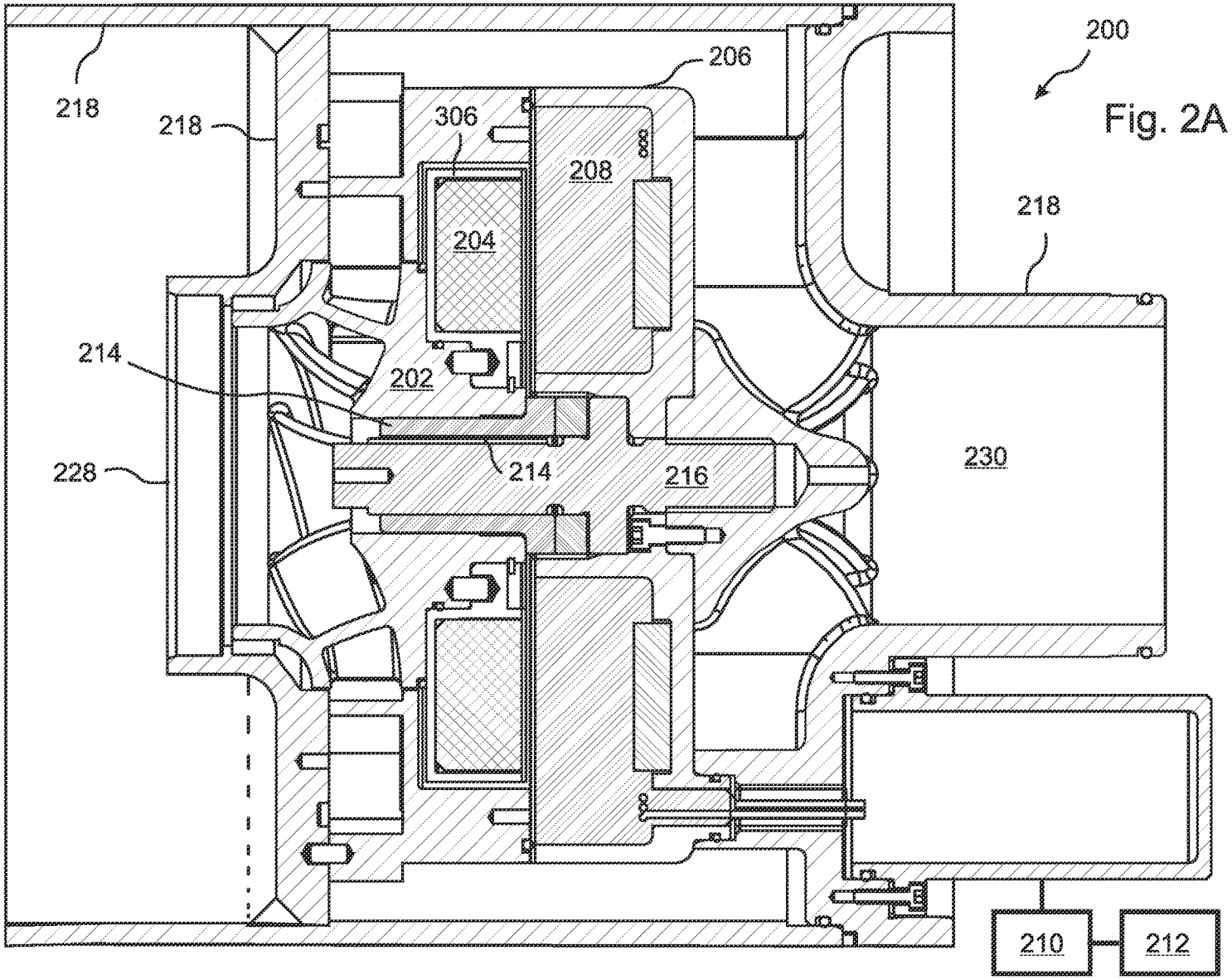
FIG. 2A is a sectional view of an IMP or IMT in an embodiment of the present invention, where the figure is drawn to scale except for elements 210 and 212.
Figure 2B:
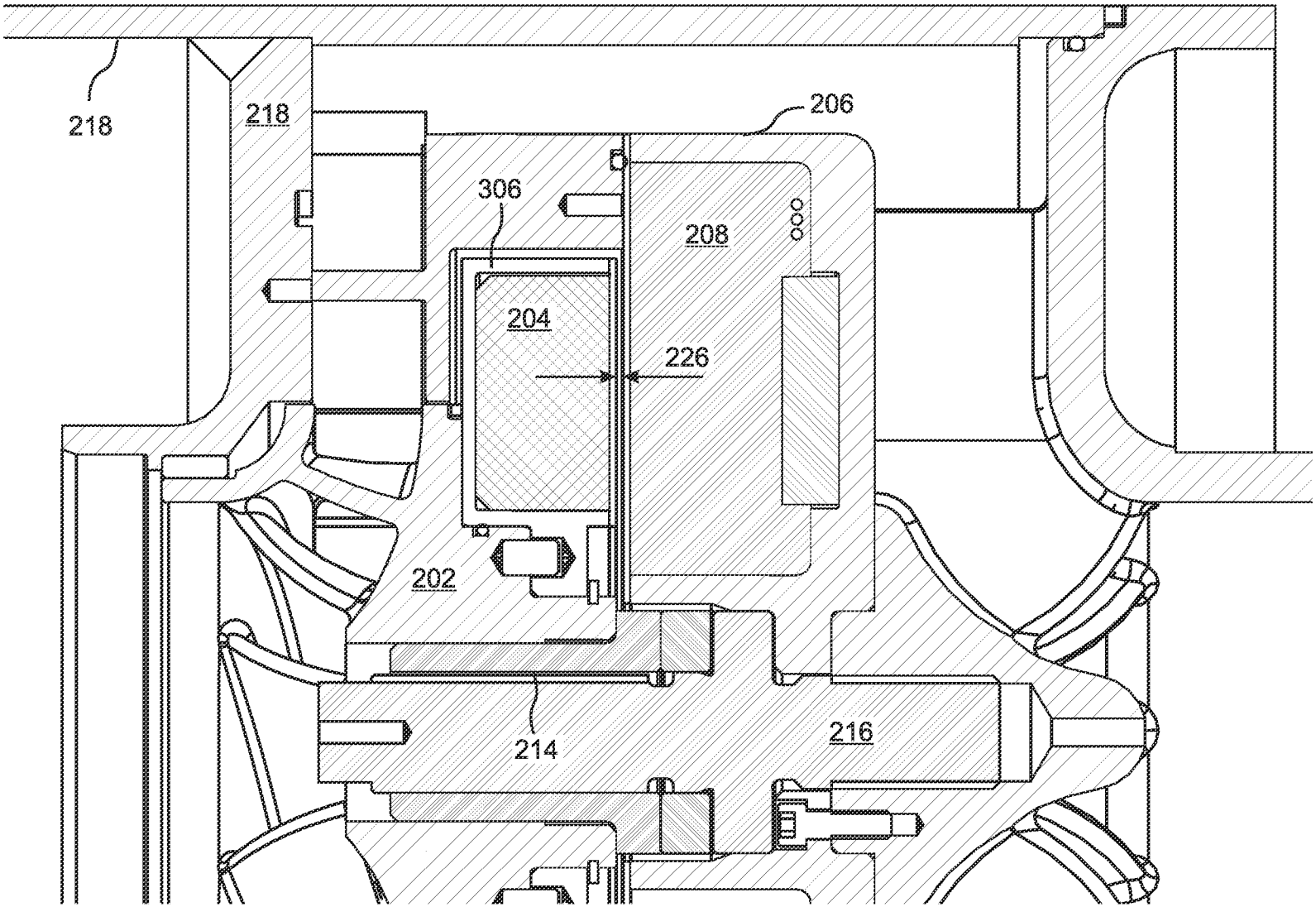
FIG. 2B is a close-up view drawn to scale of a portion of the sectional view of the IMP or IMT module of FIG. 2A.
Figure 3:
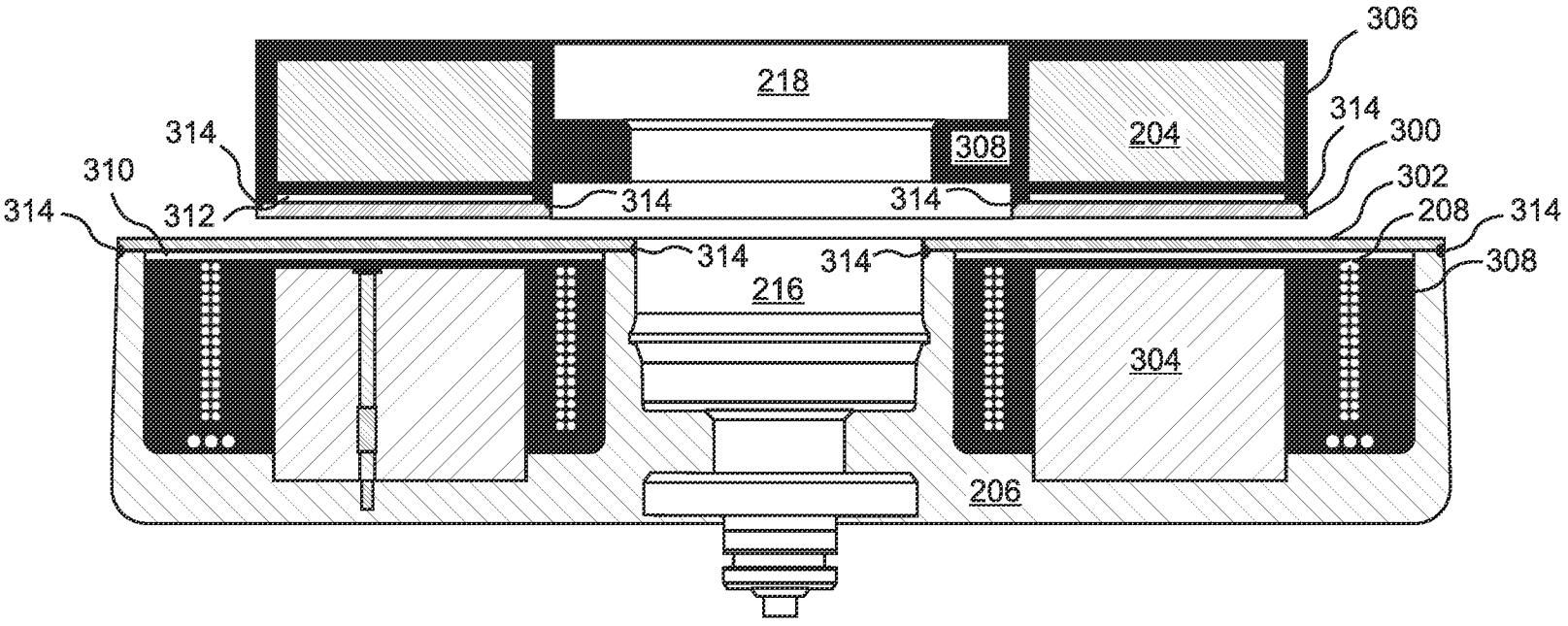
FIG. 3 is a sectional view from the side, drawn to scale, of a stator housing and associated elements shown in opposition to a rotor housing containing a ring of permanent magnets according to an embodiment of the present invention.

With reference to FIGS. 2A, 2B, and 3, the present invention is applicable to axial direct drive IMP and IMT modules that include at least one of a rotor housing 206 hermetically sealed by a rotor cover plate 302 and a stator housing 306 hermetically sealed by a stator cover plate 300. For simplicity of expression, the present disclosure sometimes refers generically to IMPs. However, it will be understood that the disclosure presented herein applies equally to turbines, and that references herein to IMPs refer generically to both pumps (IMPs) and turbines (IMTs). Also for clarity of expression, the present disclosure sometimes refers generically to the "stator housing 206" and "stator cover plate 302," or simply to the "housing 206" and the "cover plate 302." However, it will be understood that, unless otherwise stated or required by context, such references refer to either or both of the stator housing 206 and the rotor housing 306, in combination with their respective cover plates 302, 300, depending on whether the induction coils or permanent magnets 204 are hermetically sealed within a rotor housing 306 by a rotor cover plate 300, the stator coils 208 are hermetically sealed within a stator housing 206 by a stator cover plate 302, or both. It will also be understood that references herein to "permanent magnets 204" refer generically to either permanent magnets or induction coils attached to the impeller 202, unless otherwise required by context.

Figure 1:
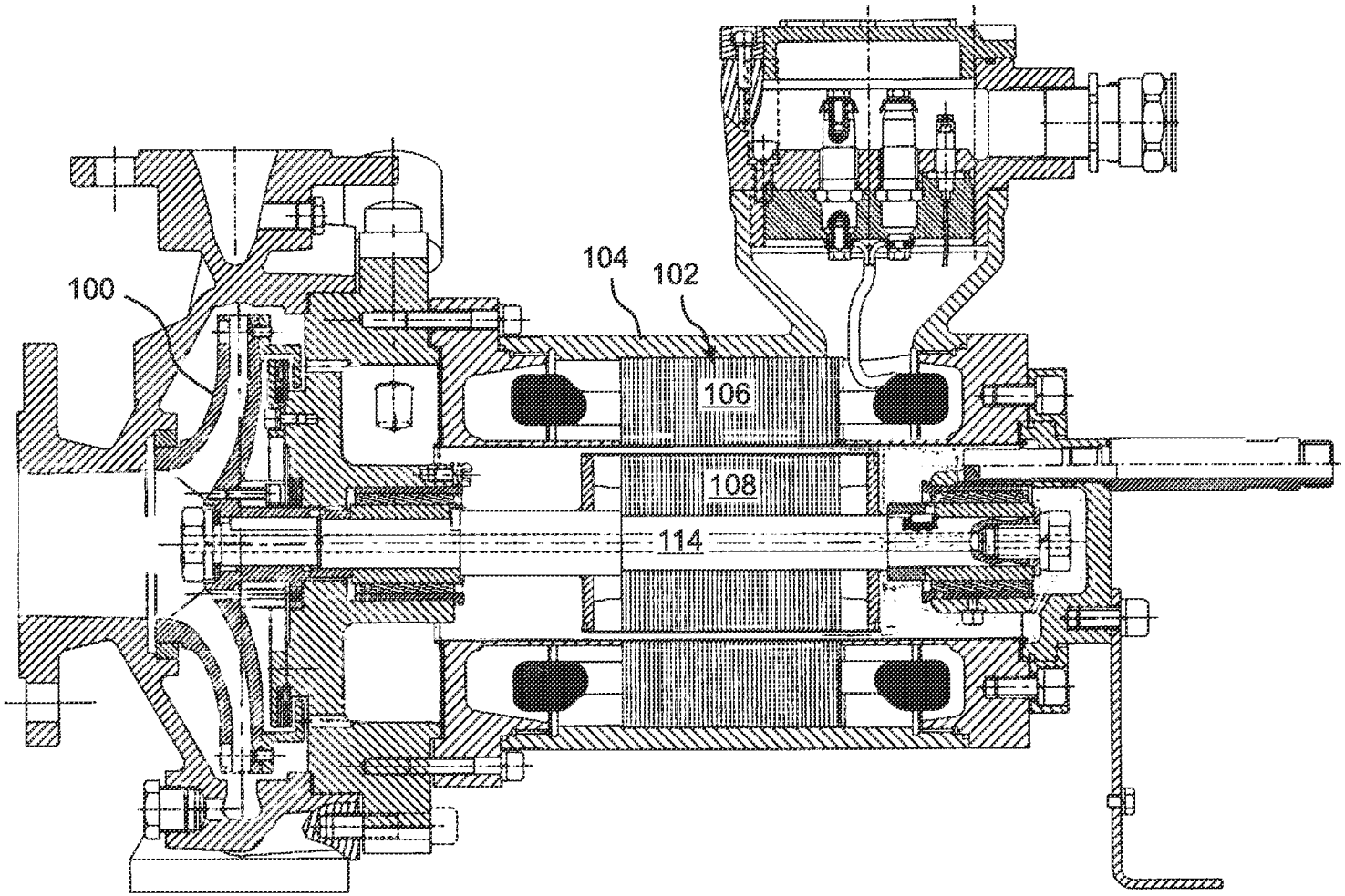
Fig. 1 (Prior Art)
FIG. 1 is a sectional view of a sealless pump of the prior art.

With continuing reference to FIGS. 2A and 2B, in embodiments, the disclosed IMP or IMT implements a "direct drive" configuration that is similar to configurations disclosed in U.S. Pat. No. 11,323,003, also by the present applicant, which is herein incorporated by reference in its entirety for all purposes. Rather than configuring an armature 108 and stator 106 in a separate motor 102 to drive a shaft 114 that drives an impeller 100, as illustrated in FIG. 1, induction coils or permanent magnets 204 are attached directly to the impeller 202, and arranged such that they are proximally and axially aligned with the stator coils 208 provided in the stator housing 206, such that in IMP embodiments the stator is able to impart torque directly to the impeller 202, rather than imparting torque to a shaft 114, and thereby indirectly imparting torque to the impeller 100. Similarly, in IMT embodiments the permanent magnets 204 are able to transfer energy directly to the stator coils 208.

The embodiment of FIGS. 2A and 2B is configured to draw a fluid from a module inlet 228 and deliver the fluid to a module outlet 230. The "rotor," i.e. the assembly of rotating components, in the IMP module 200 comprises an impeller 202 and a plurality of permanent magnets 204 that are cooperative with the impeller 202. The IMP module 200 further includes a stator housing 206 containing stator coils 208 that are positioned in axial opposition to the permanent magnets 204. Similar embodiments include induction coils in place of the permanent magnets 204.

The stator coils 208 are energized by a power source 210 that is actuated by a controller 212, and the permanent magnets 204 and stator coils 208 function cooperatively together as a synchronous motor that applies rotational torque directly to the impeller 202. In the illustrated embodiment, the power source 210 is a variable frequency drive (VFD), which enables the impeller rotation rate to be variable, in that the electrical impulses that are emitted by the VFD 210 are variable in frequency, and the impeller rotation is synchronous with the VFD impulse frequency.

In addition to the impeller 202 and the permanent magnets 204, in the illustrated embodiment the rotor includes a bearing 214 that provides rotatable support to the impeller 202 and is configured to allow the rotor to rotate about a fixed, non-rotating shaft 216. In the illustrated embodiment, the bearing 214 is product lubricated, and the shaft 216 is firmly anchored to the stator housing 206, which is firmly attached to the module housing 218. The shaft 216 is only slightly longer than the bearing 214, and does not rotate. It can be seen in the close-up, partial view of FIG. 2B that only a very narrow rotor-stator gap 226 separates the permanent magnets 204 from the stator coils 208.

FIG. 3 is a sectional view from the side of a stator housing 206 and associated elements shown in opposition to a rotor housing 306 that contains the permanent magnets 204. A metallic rotor housing cover plate 300 and a metallic stator cover plate 302 are also shown attached respectively to the rotor housing 306 and the stator housing 206 by welds 314. Also shown in the figure are the laminated steel cores 304 about which the stator coils 208 are wound.

In FIG. 3, the stator housing 206 and rotor housing 306 in FIG. 3 have both been filled with a resin barrier material 308 that was poured into the housings 206, 306 through the open fronts of the housings before they were sealed by the cover plates 302, 300. The barrier material 308 fills most of the interiors of the stator housing 206 and the rotor housing 306, surrounding the permanent magnets 204 and stator coils 208, but air-filled gaps 310, 312 remain between the barrier material 308 and the cover plates 302, 300.

Figure 4A:
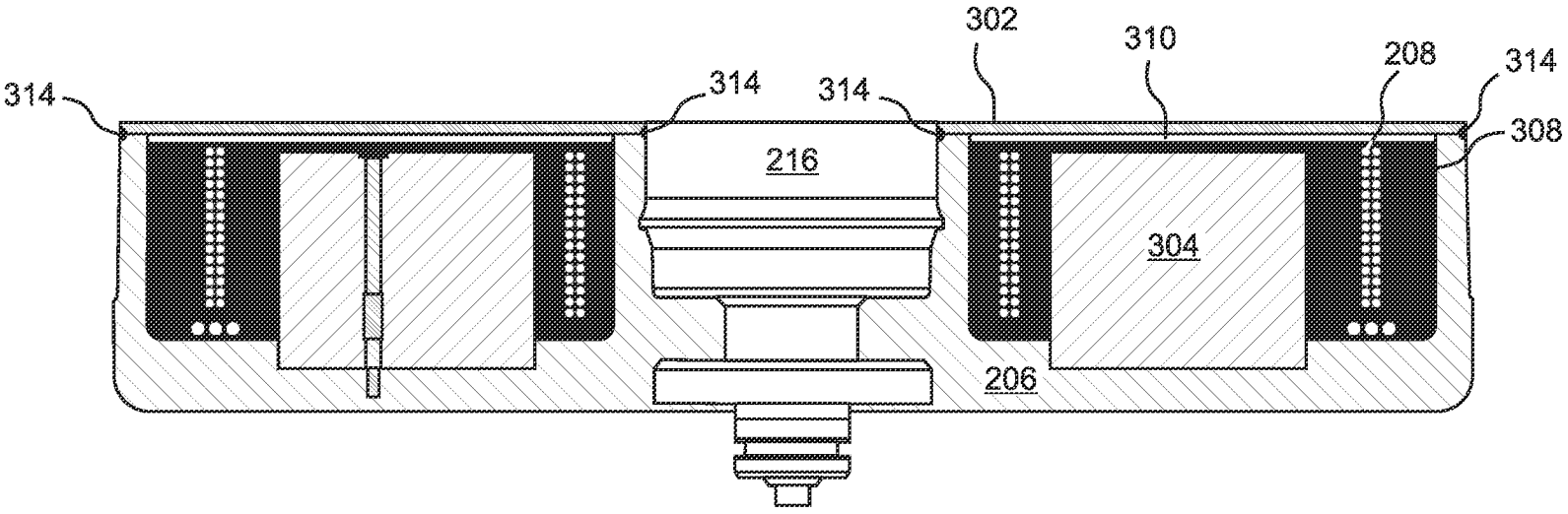
FIG. 4A is a sectional view from the side, drawn to scale of just the stator of FIG. 3.
Figure 4B:
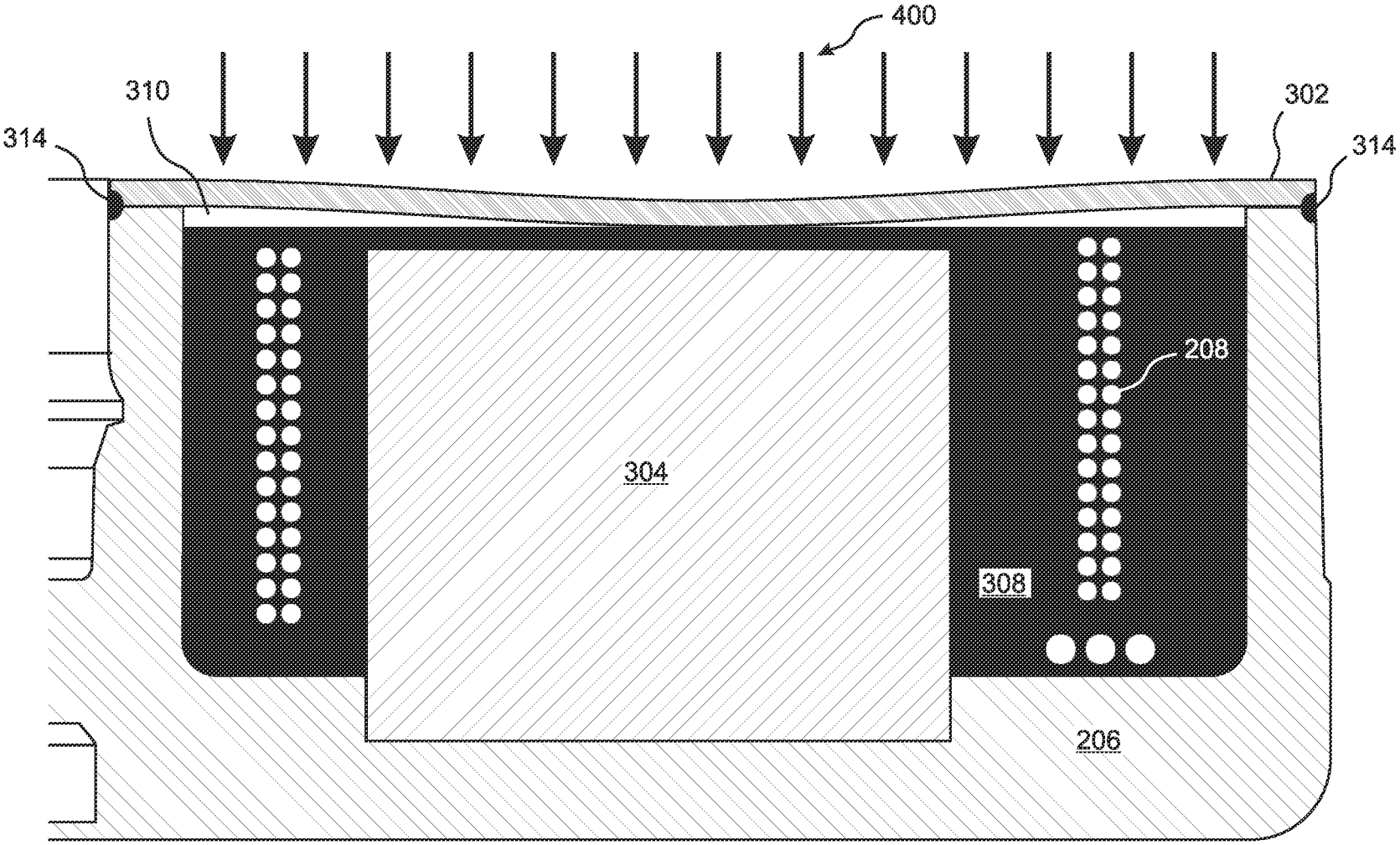
FIG. 4B is an enlarged sectional view, drawn to scale, of a portion of the sectional view of FIG. 4A, showing deformation of the cover plate by a pressurized process fluid.

FIG. 4A is sectional view of just the stator housing 206 of FIG. 3, shown before introduction of a process fluid. With reference to the enlarged view of FIG. 4B, when the IMP or IMT module is filled with a process fluid that is above ambient pressure, the resulting pressure differential can apply a significant axial force 400 to the cover plate 302, of the stator housing 206, causing the cover plate 302 to be deformed and deflected inward. In the example of FIG. 4B, the deformation of the cover plate 302 is limited by direct contact between the deformed cover plate 302 and the underlying barrier material 308. However, it can be difficult to precisely control the height to which the housing 206 is filled with the barrier material 308, such that the depth of the air "gap" 310 can vary between nominally identical IMP and IMT modules. Accordingly, a danger exists that, for some housings, the deflection of the cover plate 302 may progress until the cover plate 302 is cracked and the hermetic seal of the housing 206 is breached, allowing process fluid to pass into the interior of the housing 206. This danger can be increased when the IMP or IMT is applied to a cryogenic process liquid, such as liquid hydrogen, due to an increased brittleness of the cover plate material and an increase in the depth of the air gap 310 due to shrinkage of the internal stator components at very low temperatures.

Figure 5:
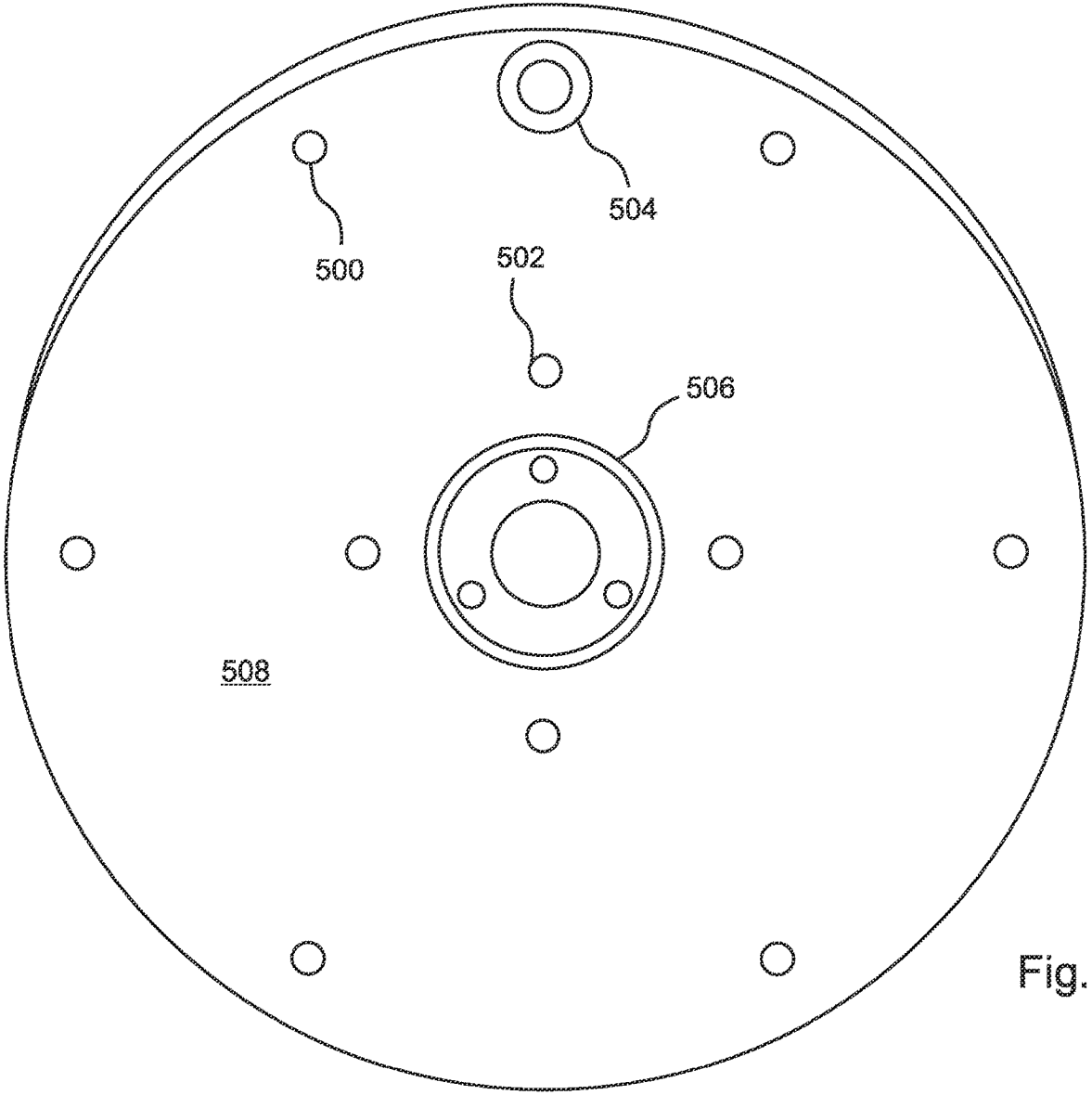
FIG. 5 is a rear of a rear face of a stator housing in an embodiment of the present invention having a plurality of fill ports located radially outward of a plurality of drain ports.
Figure 6:
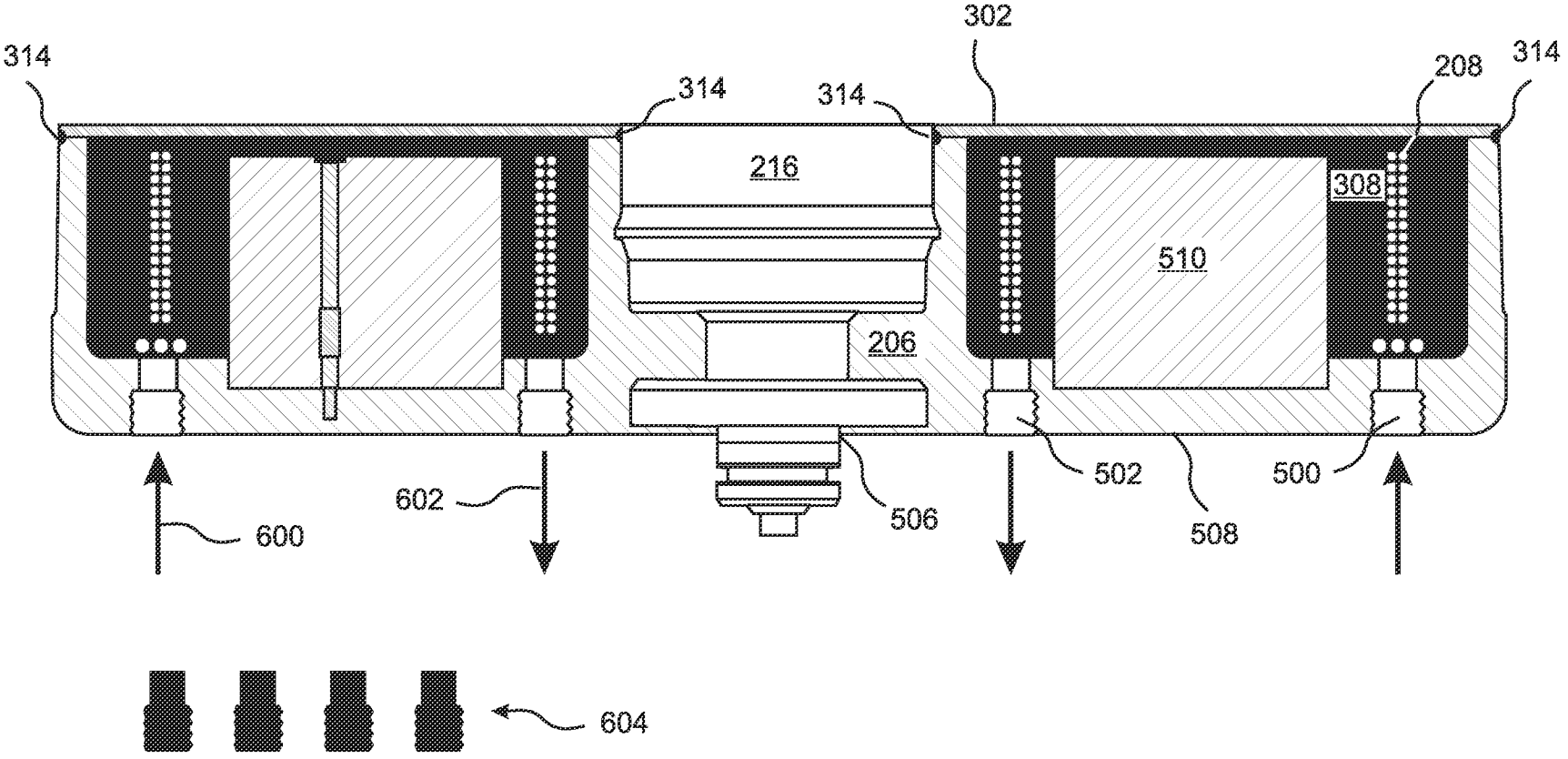
FIG. 6 is a sectional view, drawn to scale, of the stator housing of FIG. 5.

According to the present invention, with reference to FIGS. 5 and 6, at least one barrier material port 500, 502 is provided in a rear surface 508 of the housing 206. Rather than filling the housing 206 with the barrier material 308 through the open front of the housing 206 before the cover plate 300 is applied, the barrier material ports 500, 502 are used to fill the housing 206 with the barrier material 308 after the cover plate 300 has been applied, so that the barrier material 308 directly abuts the cover plate 300, without any intervening gap. In embodiments, bonding of the resin or other barrier material 308 to the cover plate 300 is avoided by applying an anti-bonding layer (not shown) to the inward face of the cover plate 300 before it is attached to the housing 206.

Also shown in FIGS. 5 and 6 are the shaft attachment flange 506 to which the shaft 216 is attached, as well as the energizing port 504 through which wires pass through the stator housing 206 to connect the stator coils 208 to the power source 210.

In the illustrated embodiment, the barrier material ports 500 are provided proximate an outer diameter of the annular rear surface 508 of the housing 206, and also proximate an inner diameter of the annular rear surface 508 of the housing 206. In method embodiments of the present invention, the outer barrier material ports 500 are used as fill ports, while the inner barrier material ports 502 are used as drain ports. This arrangement promotes an orderly flow of the barrier material 308 through the fill ports 500 axially and radially into 600 the housing 206 as the air is displaced out 602 through the drain ports 502. In some embodiments, filling of the housing 206 with the barrier material 308 takes place under vacuum in a vacuum impregnation process. In some of these embodiments, drain ports 502 are not required, and certain of these embodiments include only one fill port 500.

After the housing 206 has been filled with the barrier material 308, the barrier material ports 500, 502 are sealed. In some embodiments, the barrier material 500, 502 are threaded, and are sealed by compatibly threaded barrier material plugs 604. In the illustrated embodiment, the threaded barrier material ports 500, 502 and barrier material plugs 600 are tapered, which ensures that a hermetic seal is formed between the barrier material plugs 600 and the housing 206. In other embodiments, the barrier material ports 500, 502 are not threaded, and are sealed by inserting unthreaded barrier material plugs 600 into the barrier material ports 500, 502 and then attaching the barrier material plugs 600 to the housing 206, for example by an adhesive or by laser-welding, to provide a hermetic seal.

For embodiments that will be subject to temperature extremes, a resin or other barrier material 308 can be chosen having a coefficient of thermal expansion (CTE) that is substantially matched to the CTE of the housing 206, thereby eliminating undue stressing of the cover plate 300, 302 that could otherwise arise from unequal thermal expansion or contraction of the housing 206 and barrier material 308.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the disclosure is not limited to just these forms, but is amenable to various changes and modifications. The present application does not explicitly recite all possible combinations of features that fall within the scope of the disclosure. The features disclosed herein for the various embodiments can generally be interchanged and combined into any combinations that are not self-contradictory without departing from the scope of the disclosure. In particular, the limitations presented in dependent claims below can be combined with their corresponding independent claims in any number and in any order without departing from the scope of this disclosure, unless the dependent claims are logically incompatible with each other.

What is claimed is:

1. An integral motor pump module (IMP) or integral motor turbine module (IMT) comprising:

a module housing configured to enable a fluid to pass from an input thereof to an output thereof;

an impeller rotatable with or about a shaft within the module housing;

a plurality of permanent magnets or induction coils fixed to a distal face of the impeller;

a plurality of stator coils fixed to the module housing and configured to be axially proximate the permanent magnets or induction coils when the impeller rotates, the permanent magnets or induction coils being axially separated from the stator coils by a rotor-stator gap;

a first integral motor housing (first IM housing) having a first IM housing interior, the first IM housing being either an impeller housing fixed to the impeller and containing the plurality of permanent magnets or induction coils within the first IM housing interior, or a stator housing fixed to the module housing and containing the plurality of stator coils within the first IM housing interior;

a first IM cover plate hermetically sealing a front face of the first IM housing, wherein the first IM cover plate is a flat cover plate that abuts and is parallel to the rotor-stator gap;

a first barrier material port penetrating a rear face of the first IM housing;

a first barrier material plug configured to hermetically seal the first barrier material port; and a barrier material substantially filling the first IM housing interior in physical contact with the first IM cover plate, such that there is substantially no gap between an inward face of the first IM cover plate and the barrier material.

2. The IMP or IMT of claim 1, wherein the IMP or IMT comprises both the impeller housing fixed to the impeller and containing the plurality of permanent magnets or induction coils, and the stator housing containing the plurality of stator coils, the first IM housing being one of the impeller housing and the stator housing, and a second IM housing being the other of the impeller housing and the stator housing.

3. The IMP or IMT of claim 1, wherein the first barrier material port and first barrier material plug are configured for threaded attachment to each other.

4. The IMP or IMT of claim 1, wherein the first barrier material port and the first barrier material plug are both tapered.

5. The IMP or IMT of claim 1, wherein the first barrier material port is one of a plurality of barrier material ports, and the first barrier material plug is one of a plurality of barrier material plugs, each of the barrier material ports being sealed by a corresponding one of the barrier material plugs.

6. The IMP or IMT of claim 5, wherein the plurality of barrier material ports comprises a second barrier material port, the first barrier material port being located radially inward of the second barrier material port.

7. The IMP or IMT of claim 1 wherein the barrier material is a resin.

8. The IMP or IMT of claim 1, wherein the first IM cover plate is hermetically sealed to the front face of the first IM housing by welding.

9. The IMP or IMT of claim 8, wherein the welding is laser welding.

10. The IMP or IMT of claim 1, wherein the shaft is a non-rotatable stud fixed to the module housing.

11. The IMP or IMT of claim 10, wherein the non-rotatable stud is fixed to the stator housing, and thereby fixed to the module housing.

12. The IMP or IMT of claim 1, wherein a coefficient of thermal expansion (CTE) of the barrier material is substantially equal to a CTE of the first housing.

13. A method of filling an IM housing with a barrier material, the method comprising:

providing an IMP or IMT according to claim 1;

evacuating the IM housing interior;

injecting the barrier material through the first barrier material port into the first IM housing interior, thereby causing the barrier material to substantially fill the first IM housing interior in physical contact with the first IM cover plate, such that there is substantially no gap between an inward face of the first IM cover plate and the barrier material; and installing the first barrier material plug in the first barrier material port, thereby hermetically sealing the first barrier material port.

14. The method of claim 13, further comprising, before injecting the barrier material into the first IM housing interior, applying an anti-bonding layer to the inward face of the cover plate, thereby preventing adhesion of the barrier material to the inward face of the first IM cover plate.

15. The method of claim 13, wherein a coefficient of thermal expansion (CTE) of the barrier material is substantially equal to a CTE of the first housing.

16. A method of filling an IM housing with a barrier material, the method comprising:

providing an IMP or IMT according to claim 6;

injecting the barrier material into the first IM housing interior through one of the first barrier material port and the second barrier material port, while allowing air to escape from within the first IM housing interior through the other of the first barrier material port and the second barrier material port, thereby causing the barrier material to substantially fill the first IM housing interior in physical contact with the first IM cover plate, such that there is substantially no gap between an inward face of the first IM cover plate and the barrier material;

installing the first barrier material plug in the first barrier material port, thereby hermetically sealing the first barrier material port; and installing the second barrier material plug in the second barrier material port, thereby hermetically sealing the second barrier material port.

17. The method of claim 16, further comprising, before injecting the barrier material into the first IM housing interior, applying an anti-bonding layer to the inward face of the cover plate, thereby preventing adhesion of the barrier material to the inward face of the first IM cover plate.

18. The method of claim 16, wherein a coefficient of thermal expansion (CTE) of the barrier material is substantially equal to a CTE of the first housing.

* * * * *